US008767994B2

(12) United States Patent
Tam

(10) Patent No.: US 8,767,994 B2
(45) Date of Patent: Jul. 1, 2014

(54) GAS FILLED SPEAKER VOLUME

(75) Inventor: Ching Yu John Tam, Los Gatos, CA (US)

(73) Assignee: Apple Inc., Cupertino, CA (US)

( * ) Notice: Subject to any disclaimer, the term of this patent is extended or adjusted under 35 U.S.C. 154(b) by 310 days.

(21) Appl. No.: 12/950,852

(22) Filed: Nov. 19, 2010

(65) Prior Publication Data

US 2012/0128190 A1 May 24, 2012

(51) Int. Cl.
*H04R 1/02* (2006.01)

(52) U.S. Cl.
USPC ..... 381/351; 381/345

(58) Field of Classification Search
USPC ..... 381/345
See application file for complete search history.

(56) References Cited

U.S. PATENT DOCUMENTS

| | | | | |
|---|---|---|---|---|
| 2,797,766 | A * | 7/1957 | Sullivan | 181/151 |
| 3,378,098 | A * | 4/1968 | Eiseman, Jr. | 181/148 |
| 3,674,109 | A | 7/1972 | Murase | |
| 4,101,736 | A * | 7/1978 | Czerwinski | 381/332 |
| 4,356,882 | A * | 11/1982 | Allen | 181/151 |
| 4,875,546 | A * | 10/1989 | Krnan | 181/160 |
| 4,887,197 | A | 12/1989 | Effinger | |
| 4,889,208 | A * | 12/1989 | Sugihara | 181/148 |
| 5,108,338 | A | 4/1992 | Margolis | |
| 5,357,586 | A | 10/1994 | Nordschow et al. | |
| 5,703,337 | A | 12/1997 | Geisenberger | |
| 6,381,337 | B1 | 4/2002 | Greenberg | |
| 6,771,791 | B2 | 8/2004 | Shelley et al. | |
| 7,744,733 | B2 * | 6/2010 | Khan et al. | 204/278 |
| 7,925,035 | B2 * | 4/2011 | Stenmark et al. | 381/345 |

FOREIGN PATENT DOCUMENTS

EP 0129320 A1 12/1984

OTHER PUBLICATIONS

"Helium Speaker", Halfbakery: helium speaker, Internet article at: http://www.halfbakery.com/idea/helium_20speaker, Mar. 2, 2010, 2 pages.

Djurek, Ivan , et al., "Turbulent and Viscous Air Friction in the Mid-High Frequency Loudspeaker", Audio Engineering Society, Convention Paper 7355, Presented at the 124th Convention, May 17-20, 2008, Amsterdam, The Netherlands, 6 pages.

* cited by examiner

*Primary Examiner* — Joseph Saunders, Jr.
(74) *Attorney, Agent, or Firm* — Brownstein, Hyatt, Farber & Schreck, LLP

(57) ABSTRACT

A speaker enclosure includes a gas cavity and an air cavity separated by a flexible membrane. A diaphragm is located roughly in an opening of the enclosure surrounding the gas cavity and attached to the enclosure by an outer suspension member. The enclosure, the flexible membrane, the diaphragm, and the outer suspension member are gas and air impermeable. The enclosure surrounding the air cavity has a vent hole to allow air to travel into and out of the air cavity for barometric pressure equalization of the gas cavity. Other embodiments are also described and claimed.

22 Claims, 5 Drawing Sheets

GAS FILLED SPEAKER VOLUME

The various embodiments of the invention relate to speaker systems and more specifically, to a gas filled volume of a speaker enclosure used in, for instance, a mobile device such as a smartphone.

BACKGROUND

In most speaker systems, a vibrating diaphragm is mounted at an opening of a speaker enclosure. A common type of speaker enclosure is a sealed enclosure. In a sealed speaker enclosure, the diaphragm compresses air in the enclosure when it moves in and rarefies air when it moves out. In smaller speaker and enclosure designs, substantial back pressures are exerted against the vibrating diaphragm by the air within the enclosure. This back pressure retards the movement of the diaphragm and degrades the quality of the sound being reproduced. To effectively enlarge the volume of the speaker enclosure, the air within the enclosure can be replaced with a gas that is less dense than air.

However, with mobile devices, the barometric air pressure surrounding the speaker enclosure can decrease or increase abruptly, for example when the user is riding in an elevator. This will result in a net force being exerted on the diaphragm of the sealed speaker system, causing it to "stick" and therefore stop producing sound until the pressure inside the speaker has equalized with the barometer pressure (due to leakage). In air speaker systems, such barometric equalization is achieved relatively quickly (in order to prevent noticeable sticking of the diaphragm), by adding a small vent hole to the enclosure (at the expense of a small amount of sound quality degradation). This solution however will not work for an enclosure that is filled with gas and no air.

SUMMARY

A speaker system for enlarging the effective volume of a speaker enclosure is described. The speaker system includes a speaker enclosure having an interior partition to separate a gas cavity and an air cavity. A diaphragm is located at an opening of the enclosure surrounding the gas cavity. The gas cavity is filled with a gas that is less dense than air (e.g., helium or hydrogen) to effectively enlarge the volume of the gas cavity. The interior partition separating the gas cavity and the air cavity has an opening that is sealed by a flexible membrane. The enclosure surrounding the air cavity has a vent hole to allow the surrounding air to travel into and out of the air cavity.

As the air pressure surrounding the speaker enclosure decreases, the gas inside the enclosure will be allowed to expand. The flexible membrane between the gas cavity and the air cavity may allow the gas to expand without significantly increasing the net force on the diaphragm as the vent hole will allow air to travel out of the air cavity. Similarly, when the air pressure surrounding the speaker enclosure increases, the gas within the enclosure will be allowed to contract. The vent hole will allow the air to travel into the air cavity, and the flexible membrane will allow the gas to contract without creating a vacuum on the diaphragm. Therefore, there is very little pressure change on the diaphragm when the barometric pressure changes.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

Embodiments of the invention will now be described with reference to the drawings summarized below. The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Several embodiments of the invention with reference to the appended drawings are now explained. Whenever the shapes, relative positions, and other aspects of the parts described in the embodiments are not clearly defined, the scope of the invention is not limited only to the parts shown, which are meant merely for the purpose of illustration. Also, while numerous details are set forth, it is understood that some embodiments of the invention may be practiced without these details. In other instances, well-known circuits, structures, and techniques have not been shown in detail so as not to obscure the understanding of this description.

Figure 1:
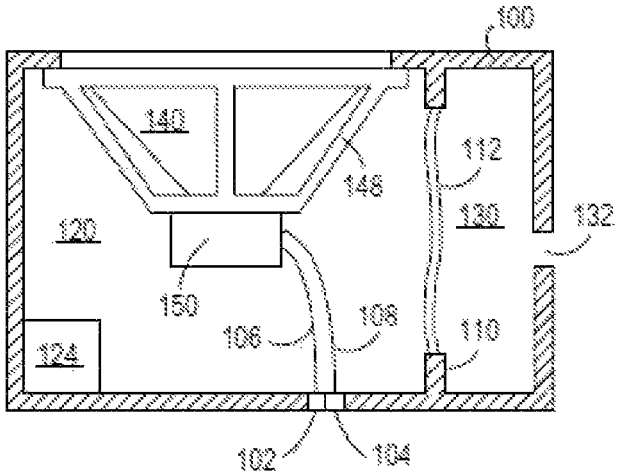
FIG. 1 is a sectional view of a speaker system according to an embodiment.

Referring to FIG. 1, the speaker system according to an embodiment of the invention may include an enclosure 100 made of rigid material that is air and gas impermeable, for example, aluminum or plastic. The "gas" here refers to less dense than air gases, such as hydrogen and helium. The enclosure 100 has an interior partition 110 that may also be made of the same rigid material, for example, as a single extrusion or molded piece. The interior partition 110 has an opening that is sealed by a flexible membrane 112 as shown. The interior partition 110 and the flexible membrane 112 separate a gas cavity 120 from an air cavity 130. The interior partition 110 and the flexible membrane 112 are air and gas impermeable to seal off the gas cavity 120 from the air cavity 130.

Figure 2:
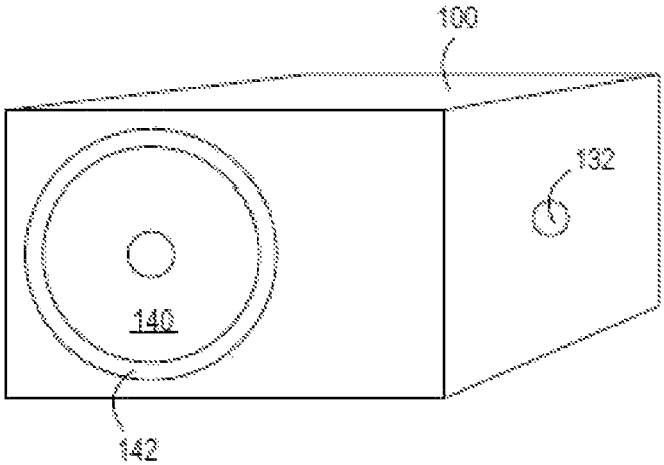
FIG. 2 is a perspective view of the speaker system of FIG. 1.
Figure 3:
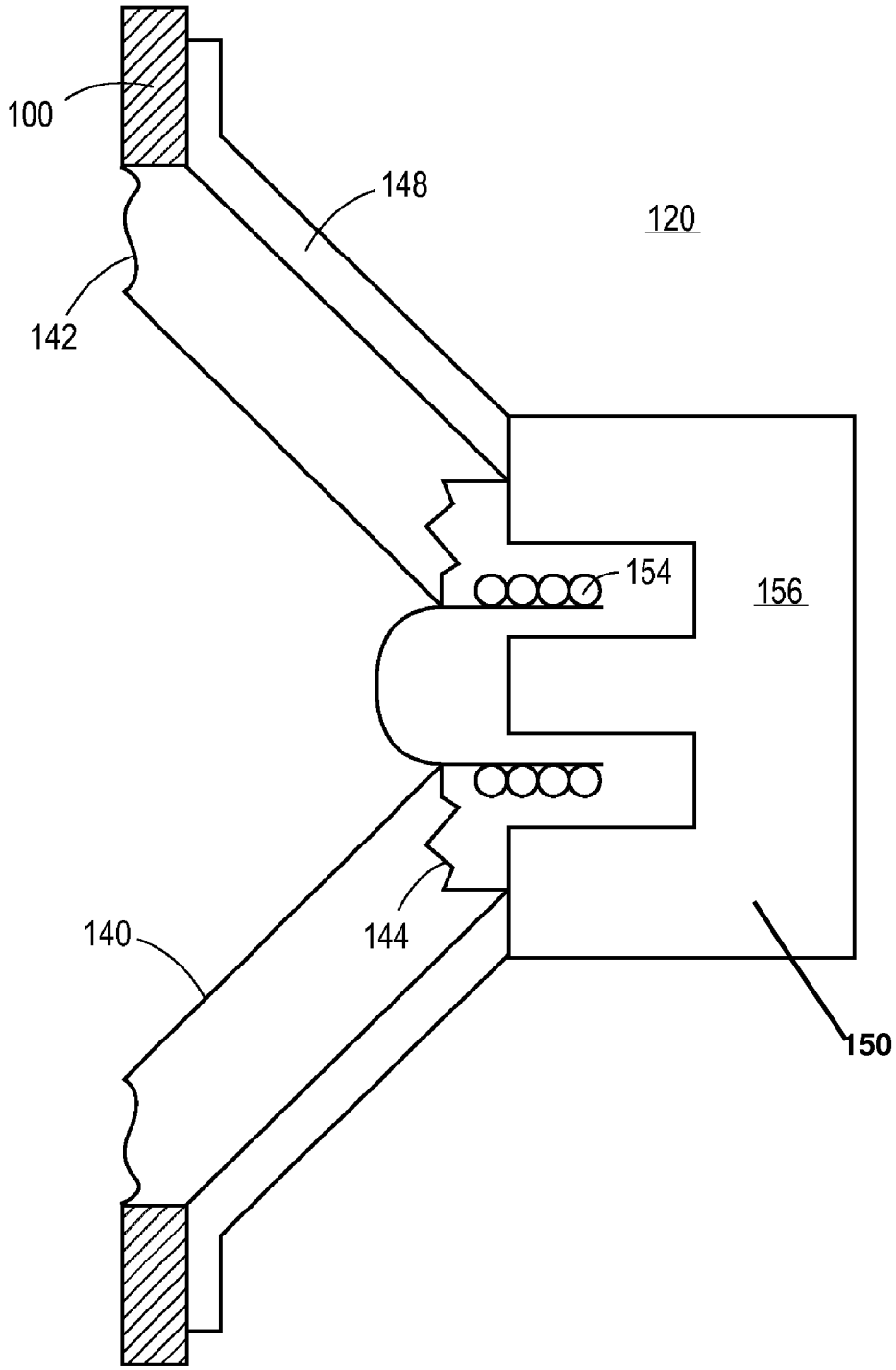
FIG. 3 is a sectional view of a speaker showing details of the drive assembly.

The enclosure 100 surrounding the gas cavity 120 has an opening in which a vibratable diaphragm, or cone, 140 is located. The diaphragm 140 is attached to the enclosure 100 by an outer suspension member, also referred to as an edge or a surround, 142 as shown in FIG. 2 and FIG. 3. The surround 142 is flexible to allow the diaphragm 140 to vibrate in order to produce sound or acoustic pressure waves. As seen in FIG. 1, the enclosure surrounding the gas cavity 120 may have at least one, here two, electrical signal ports 102 and 104 to allow transfer of electrical audio signals into the enclosure. The enclosure 100, the diaphragm 140, the surround 142, and the electrical signal ports 102 and 104 are air and gas impermeable to seal off the gas cavity 120 completely from the air (atmosphere) surrounding the outside of the enclosure 100.

In addition to the diaphragm 140 and the surround 142, the speaker may have a drive assembly 150. As shown in FIG. 3, the drive assembly 150 may have a coil 154 and a magnet 156. The coil 154 may be attached to the diaphragm 140, and the magnet 156 may be rigidly attached to the enclosure 100 by a rigid frame, or basket, 148. In this embodiment, the drive assembly 150 is located completely within the gas cavity 120 (see FIG. 1). When an input electrical audio signal is applied to the coil 154 through the electrical signal wires 106 and 108, a magnetic field is created by the current in the coil 154. The coil 154 and the magnet 156 interact, generating a mechanical force that causes the coil 154 and the diaphragm 140 to vibrate in accordance with the input audio signal, producing sound per the input audio signal.

The speaker may also include a suspension system to keep the coil 154 centered in the gap of the magnet 156 and to provide a restoring force that returns the diaphragm 140 to a neutral position after vibrating. In addition to the surround 142, the suspension system may include an inner suspension member, or a spider, 144 as shown in FIG. 3. The spider 144 connects the diaphragm 140 or coil 154 to the frame 148. The spider 144 provides the majority of the restoring force to the diaphragm 140, and the surround 142 keeps the diaphragm 140 and the coil 154 centered.

Referring again to FIG. 1, the gas cavity 120 is filled with a gas and no air. The gas is less dense than air to effectively enlarge the volume of the gas cavity 120 so that the diaphragm 140 sees a larger compliance than it would with air. Examples of a gas that is less dense than air may include helium and hydrogen. Despite being completely sealed off, the gas may leak out of the gas cavity 120 over time. A gas emitter 124 may be placed in the gas cavity 120 or in gas communication therewith, within the enclosure 100, to replenish the leaked gas. The gas emitter 124 may be a mineral that decays to emit the gas. For example, minerals containing uranium or thorium decay to emit helium. For hydrogen, a hydrogen-rich chemical compound such as water used with a small electrolysis station may be used to emit hydrogen, for example, as part of a hydrogen fuel cell.

The gas inside the gas cavity 120 can expand and contract in response to pressure changes in the surrounding air as typically experienced by a consumer electronic personal mobile device; e.g., a smartphone, a digital music player, and a laptop computer. The flexible membrane 112 is flexible enough to allow this to occur, so as to not create a pressure delta across the diaphragm 140. The enclosure 100 surrounding the air cavity 130 protects the flexible membrane 112 from becoming damaged. The enclosure 100 surrounding the air cavity 130 has a vent hole 132 that allows air to travel into and out of the air cavity 130 for barometric pressure equalization of the gas cavity 120, by allowing the outer surface of the membrane 112 to remain at and follow the atmospheric pressure changes, such as when the speaker is in a moving elevator.

The membrane 112 is flexible relative to the enclosure 100 which is deemed rigid, as well as to the diaphragm 140. The membrane 112 may be a piece of latex or other similarly long-lived, gas impermeable sheet or layer that can be bonded to the edge of the enclosure 100 at the opening. The sheet or layer needs to be sufficiently compliant so as to allow the gas in the gas cavity 120 to expand and contract quickly while riding in an elevator, for example, so as to avoid sticking of the diaphragm 140. The membrane 112 and its associated enclosure opening may be larger than shown in FIG. 1, for example, almost as large as an entire sidewall of the enclosure 100. FIG. 2 shows an embodiment where the enclosure is essentially a hexahedron. Alternatively, the enclosure 100 could have any suitable three-dimensional solid shape, such as a polyhedron.

Figure 4:
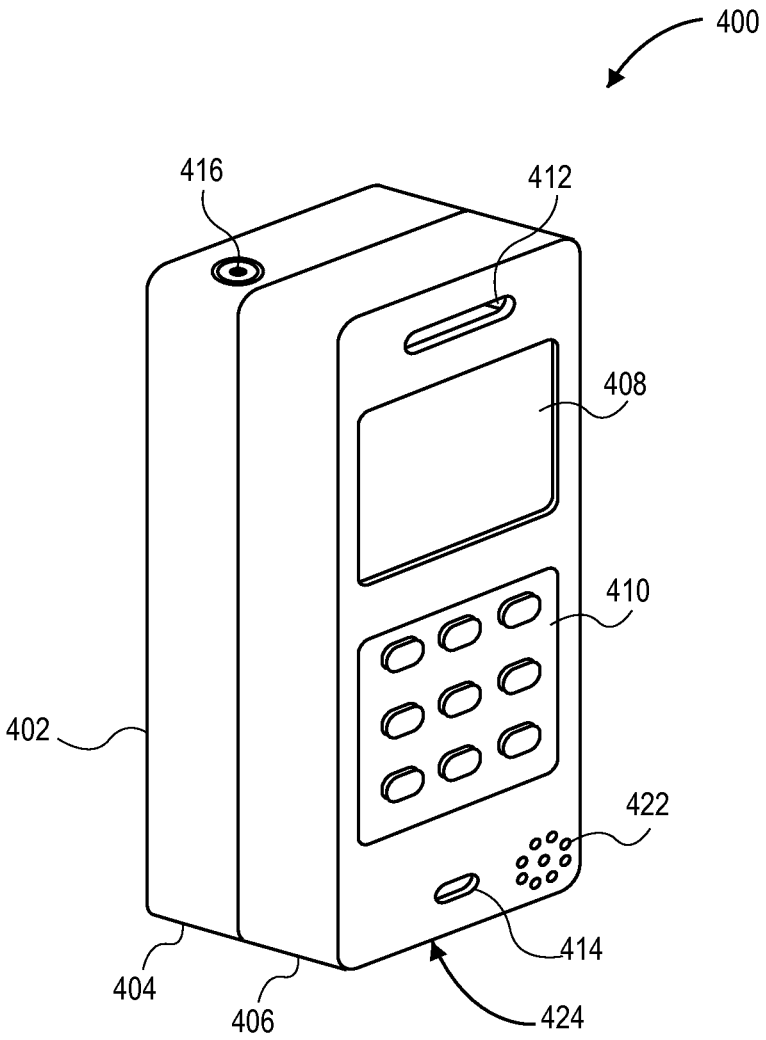
FIG. 4 is a perspective view of an example media device.

Referring to FIG. 4, the speaker system of FIG. 1 may be integrated within the housing of a personal mobile electronics device 400. The speaker may be, for example, an earpiece speaker or a speakerphone speaker that is used during a wireless telephone call, or for playing back digital music and/or audio-video files that have been downloaded into the device 400. The housing 402 includes a speakerphone speaker housing acoustic aperture 422 that may be located in proximity to a lower portion of the mobile device 400 (referred to here as the bottom end). The bottom end may also contain a microphone, with associated microphone acoustic aperture 414 in the housing 402. In certain embodiments, the microphone aperture 414 and/or the speaker aperture 422 may be located on a bottom 424 of the mobile device 400. More generally, the microphone aperture 414 and the speaker aperture 422 may be located on any other portion of the housing 402 that can facilitate the delivery and reception of sound in the manner in which the device 400 is intended to be used.

In one embodiment, the housing 402 includes a first housing portion 404 and a second housing portion 406 that are fastened together to encase various electronic components of the mobile device 400. The housing 402 may be made of polymer-based materials that are formed by, for instance, injection molding to define the form factor of the mobile device 400. The housing 402 may surround and/or support internal components, such as circuit boards having integrated circuit components, internal radio frequency circuitry, an internal antenna, a speakerphone speaker, a microphone, an earpiece speaker, nonvolatile mass storage such as nonvolatile solid state memory and/or a magnetic rotating disk drive, as well as other components. The housing 402 also provides for the mounting of a built-in display 408, a keypad 410, an earphone jack 416, and a battery charging jack (not shown). As an alternative to the separate display 408 and keypad 410, a single touch sensitive display that spans most of the area on the front face of the device 400 may be provided, for both showing information to the user, as well as accepting input by the user. In this particular embodiment, the mobile device 400 can be used as a wireless telephony handset, where the earpiece speaker aperture 412 is positioned at the top end of the palm-sized mobile device 400 to facilitate such use of the device 400.

The mobile device may include a wireless communications function, such as cellular or satellite telephony, pager, portable laptop/notebook computer, or other wireless communications function. The mobile device 400 may be, for example, an iPod or iPhone mobile device, or a palm sized personal computer such as an iPAQ Pocket PC available from Hewlett Packard, Inc., of Palo Alto, Calif. In some embodiments, the mobile device may synchronize with a remote computing system or server, to receive media using either a wireless or wireline communication path. Media may include sound or audio files, music, video, and other digital data, in either streaming and/or discrete (e.g., files) formats. The mobile device 400 may also have a wireline communication connector (not shown in FIG. 4), e.g. a 30-pin docking connector, that may be located on the bottom face of the device 400. This can be used to directly connect (e.g., dock) the device 400 to another computer.

Figure 5:
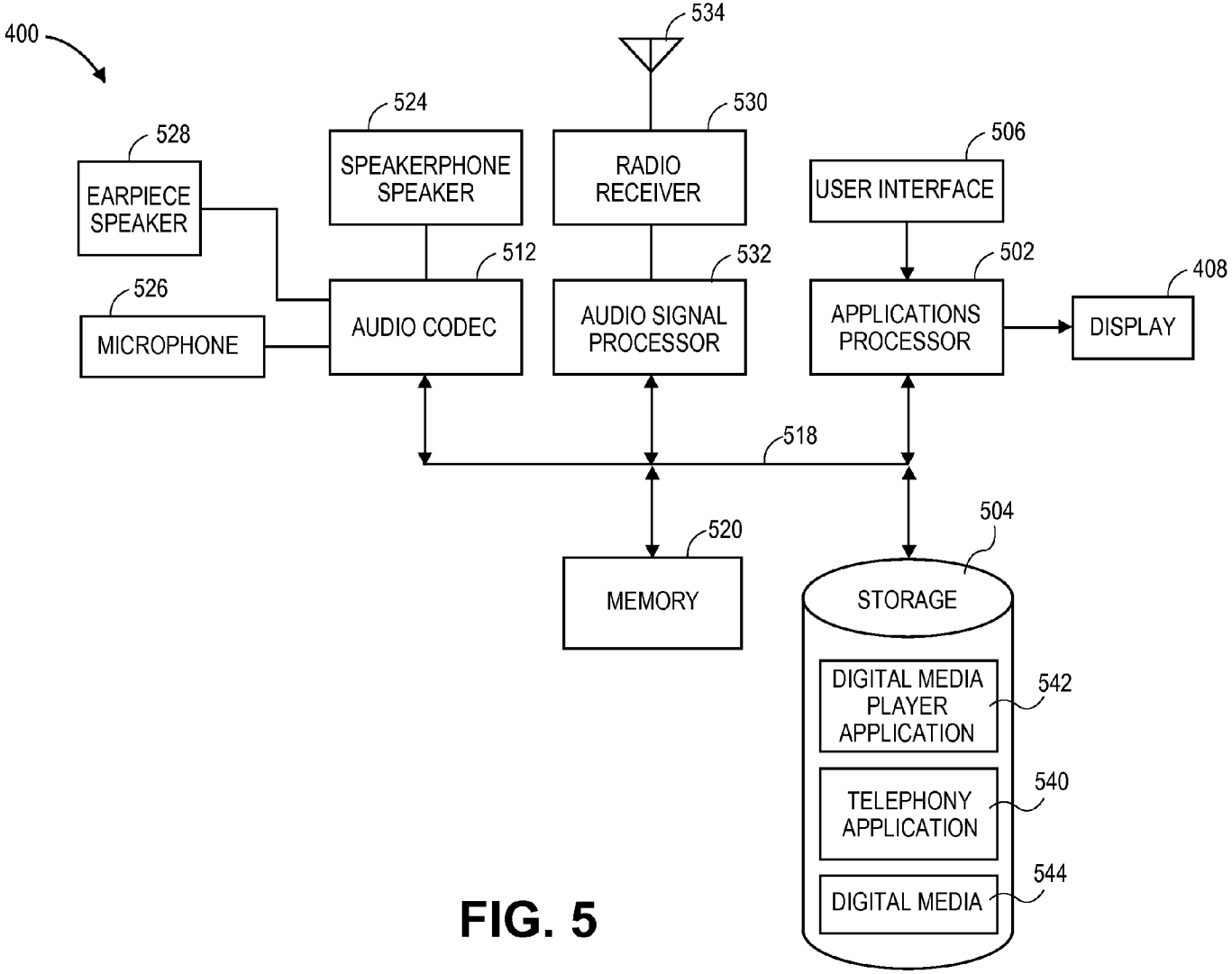
FIG. 5 is a functional block diagram of the example media device.

Turning now to FIG. 5, a simplified functional block diagram of the mobile device 400, according to an embodiment of the invention, is shown. An applications processor 502 may control the operation of many functions and other circuitry in the mobile device 400. The processor may, for example, drive the display 408 and may receive user inputs through the user interface 506 (which may be integrated with the display 408 as part of a single, touch sensitive display panel on the front face of the device 400). Storage 504 may be comprised of nonvolatile solid state memory and/or a kinetic nonvolatile storage device (e.g., rotating magnetic disk drive) that stores the different digital media 544 (e.g., music and video files, functional software, preference information, e.g., for media playback, transaction information, e.g., information such as credit card information and other user authentication information, and wireless connection information, e.g., information that may enable the mobile device to establish wireless communication with another device).

In addition to the storage 504, there may be memory 520, also referred to as main memory or program memory, to store code and data being executed by the processor. Memory 520 may be comprised of solid state random access memory. A bus 518 provides a data transfer path between the memory 520, storage 504, and the processor 502. In addition, the bus 518 may also allow communications with an audio coder/decoder (codec) 512 that is a specialized circuit that converts a digital audio signal into an analog signal for driving the speakerphone speaker 524 and/or the earpiece speaker 528. This is designed to produce sound, including voice, music and other like audio. The codec 512 may also convert sound detected by the microphone 526 into digital audio signals for storage and digital processing by the processor 502.

The mobile device 400 may also include a radio receiver 530, which is coupled to an antenna 534. The radio receiver 530 may be connected to an audio signal processor 532 that converts a received downlink signal (e.g., a cellular telephone signal or a wireless local area network signal from a base station) through demodulation and decoding into a digital audio signal. The digital audio signal may then be transferred to the audio codec 512 on bus 518 for conversion into an analog signal for driving the speakerphone speaker 524.

All of the functionality shown in FIG. 5 may be integrated within a single housing that makes the mobile device 400 a portable computing device that is battery or fuel cell operated and is palm sized. In other embodiments, however, the mobile device 400 may be somewhat larger than palm size, e.g. a laptop or notebook computer, yet nevertheless, is still considered a personal, consumer grade, stand alone mobile computing or media processing device.

While FIG. 5 depicts a functional block diagram of the device 400 in terms of mostly hardware components, there are also several software components that control and manage, at a higher level, the different functions of the media device 400. For instance, there may be a telephone application 540 that configures a built-in touch sensitive display to look like the keypad of a traditional telephony handset, and allows the user to enter a telephone number to be called, or select a previously stored number from a telephone address book. The application 540 may register the media device as a cellular handset with the nearest cellular base station (using the appropriate cellular communications protocols built into the media device). The application 540 then proceeds to allow the user to make a call, and controls the built-in microphone 526 and earpiece speaker 528 to enable the user to experience a two-way conversation during the call. Another application may be a media player application 542, such as an MP3 audio player. This would allow the user to select songs as MP3 files that have been downloaded into the media device, for playback through the built-in speakerphone speaker 524 or through the earphone jack 416 (see FIG. 4).

Figure 6:
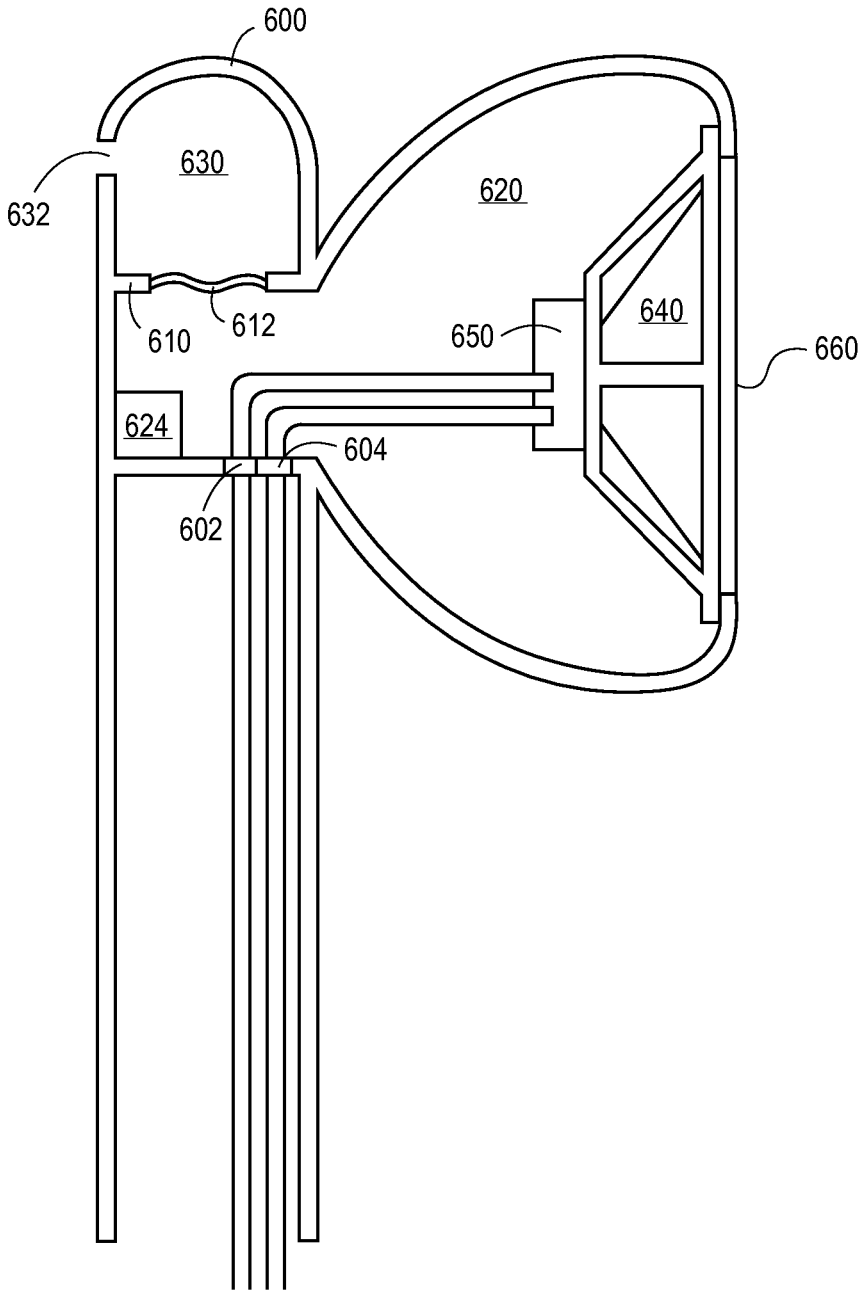
FIG. 6 is a sectional view of a speaker system according to another embodiment.

FIG. 6 shows the speaker system according to another embodiment, namely an earphone that may be plugged in to the earphone jack 416 of FIG. 4. The earphone may have an enclosure 600 made of rigid material that is air and gas impermeable, e.g., plastic. The enclosure 600 has an interior partition 610 that may also be made of rigid material. The interior partition 610 has an opening that is sealed by a flexible membrane 612. The interior partition 610 and the flexible membrane 612 separate a gas cavity 620 from an air cavity 630. The interior partition 610 and the flexible membrane 612 are air and gas impermeable to seal off the gas cavity 620 from the air cavity 630. The air cavity 630 is open to the atmosphere through a vent hole 632 formed in an exterior wall of the enclosure 600.

The enclosure 600 surrounding the gas cavity 620 has an opening through which acoustic waves produced by the diaphragm 640 can emanate. The diaphragm 640 is attached to the enclosure 600 by a surround, similar to the surround 142 of FIG. 2 and FIG. 3, and protected by a screen, or a grill, 660 in the opening. The surround is flexible to allow the diaphragm 640 to vibrate in order to produce sound or acoustic pressure waves. The speaker of FIG. 6 may include a drive assembly 650 and a suspension system similar to that shown in FIG. 3, although at a smaller size. The enclosure surrounding the gas cavity 620 may have two electrical signal ports 602 and 604 to allow transfer of an electrical audio signal and a return signal, into the enclosure. The enclosure 600, the diaphragm 640, the surround, and the electrical signal ports 602 and 604 are air and gas impermeable to seal off the gas cavity 620 completely from the air (atmosphere) surrounding the outside of the enclosure 100.

The gas cavity 620 is filled with a gas and no air. The gas is less dense than air to effectively enlarge the volume of the gas cavity 620 so that the diaphragm 640 sees a larger compliance than it would with air. Despite being completely sealed off, the gas may leak out of the gas cavity 620 over time. A gas emitter 624 may be placed in the gas cavity 620 or in gas communication therewith, within the enclosure 600, to replenish the leaked gas.

The gas inside the gas cavity 620 can expand and contract in response to or in accordance with surrounding air pressure changes caused by, for instance, riding in an elevator. The flexible membrane 612 enables this to occur so as to not create a pressure delta across the diaphragm 640. The enclosure 600 surrounding the air cavity 630 has a vent hole 632 that allows air to travel into and out of the air cavity 630 for barometric pressure equalization of the gas cavity, by allowing the outer surface of the membrane 612 to remain at and follow the atmospheric pressure changes, such as when the speaker is in a moving elevator. The enclosure 600 surrounding the air cavity 630 may also protect the flexible membrane 612 from becoming damaged.

The various embodiments of the speaker system, as shown in FIG. 1 and FIG. 6, may be manufactured in any manner that makes it suitable for operation as described above. For instance, a polyhedron or other suitable shell with an interior partition and two openings may be formed by, for example, using an injection molded plastic manufacturing process, to create the enclosure. Alternatively, the enclosure may be formed by joining (e.g., bonding) two separate halves or pieces of the shell together. A pair of electrical signal contacts may then be installed on the enclosure such that an electrical signal can pass through the enclosure while preventing the gas from leaking out of the enclosure. A gas emitter may be installed into the enclosure, or a gas port may be installed in the enclosure (to be connected to a hydrogen emitter or fuel cell outside the enclosure). A speaker frame of a speaker assembly (including the drive assembly, diaphragm, and surround already installed) may be bonded on the enclosure in the opening for the speaker assembly. The speaker assembly may be fitted with a plug that fits into or mates with the electrical signal contacts. A flexible membrane may be bonded to the opening for the membrane. A vent hole is drilled on an exterior wall of the enclosure surrounding the air cavity. The gas cavity may be filled through a temporary hole. If no leaks are present, the temporary hole is then sealed off.

For purposes of explanation, specific embodiments were described to provide a thorough understanding of the present invention. These should not be construed as limiting the scope of the invention but merely as illustrating different examples and aspects of the invention. It should be appreciated that the scope of the invention includes other embodiments not discussed in detail above. Various other modifications, changes, and variations which will be apparent to those skilled in the art may be made in the arrangement, operation, and details of the systems and methods of the present invention disclosed herein without departing from the spirit and scope of the invention as defined in the appended claims. For instance, while FIG. 3 shows the surround 142 being in contact with and bonded to an edge of the enclosure 100 (all around the opening), thereby sealing off the opening, an alternative is to have the surround 142 first bonded to the frame 148, and then bonding the frame 148 to the edge of the enclosure 100 (to seal off the opening). Therefore, the scope of the invention should be determined by the claims and their legal equivalents. Such equivalents include both currently known equivalents as well as equivalents developed in the future, i.e., any elements developed that perform the same function, regardless of structure. Furthermore, no element, component, or method step is intended to be dedicated to the public regardless of whether the element, component, or method step is explicitly recited in the claims.

What is claimed is:

1. A speaker system, comprising:

a gas-impermeable diaphragm; and a rigid enclosure made of gas-impermeable material and having an interior partition to separate a gas cavity and an air cavity, the interior partition having a first opening to the gas cavity sealed by a gas-impermeable flexible membrane comprising a sheet of material that extends across the first opening, the enclosure having a second opening to the gas cavity, the diaphragm being coupled to the enclosure through a gas-impermeable suspension member wherein the second opening is sealed by the suspension member and the diaphragm, the enclosure having a vent hole to allow air to travel into and out of the air cavity for barometric pressure equalization.

2. The speaker system of claim 1 wherein the gas cavity contains a gas that is less dense than air, and no air.

3. The speaker system of claim 2 wherein the gas is selected from a group consisting of helium and hydrogen.

4. The speaker system of claim 2 further comprising a gas emitter within the gas cavity to replenish leaked gas.

5. The speaker system of claim 4 wherein the gas emitter includes a mineral containing uranium or thorium that decays to emit helium.

6. The speaker system of claim 1 further comprising a drive assembly having a coil and a magnet, the drive assembly is attached to the diaphragm and to the enclosure to vibrate the diaphragm in response to an input electrical audio signal.

7. The speaker system of claim 6 further comprising a speaker frame to which the suspension member and the drive assembly are attached, wherein the speaker frame seals off the second opening and is inside the gas cavity.

8. The speaker system of claim 6 wherein the drive assembly is located inside the enclosure, the enclosure having a gas-impermeable electrical signal port to allow transfer of an electrical audio signal into the enclosure.

9. An apparatus, comprising:

a mobile electronics device housing having integrated therein a speaker module having a rigid enclosure made of gas-impermeable material, the rigid enclosure having an interior partition to separate a gas cavity and an air cavity, the interior partition having a first opening sealed by a gas-impermeable flexible membrane comprising a sheet of material that extends across the first opening, the enclosure surrounding the gas cavity having a second opening that is sealed by a gas-impermeable diaphragm and a gas-impermeable suspension member and that allows acoustic waves to emanate from the diaphragm when the diaphragm vibrates in response to an input electrical audio signal, the enclosure surrounding the air cavity having a vent hole to allow air to travel into and out of the air cavity for barometric pressure equalization.

10. The mobile device of claim 9 wherein the gas cavity contains a gas that is less dense than air, and no air.

11. The mobile device of claim 10 wherein the gas is selected from a group consisting of helium and hydrogen.

12. The mobile device of claim 9 wherein the speaker module includes a gas emitter within the gas cavity to replenish leaked gas.

13. The mobile device of claim 12 wherein the gas emitter includes a mineral containing uranium or thorium that decays to emit helium.

14. The mobile device of claim 9 wherein the speaker module includes a drive assembly having a coil and a magnet, the drive assembly is attached to the diaphragm and to the enclosure to vibrate the diaphragm in response to the input electrical audio signal.

15. The mobile device of claim 14 wherein the drive assembly is rigidly attached to the enclosure by a speaker frame and is located completely inside the gas cavity.

16. The mobile device of claim 9 wherein the enclosure surrounding the gas cavity has a gas-impermeable electrical signal port to allow transfer of an electrical audio signal into the speaker module.

17. A speaker system, comprising:

a gas cavity sealed by a rigid gas-impermeable enclosure, a gas-impermeable flexible membrane, and a gas-impermeable suspension member to which a gas-impermeable diaphragm is attached; and an air cavity separated from the gas cavity by the gas-impermeable flexible membrane, the air cavity having a vent hole to allow air to travel into and out of the air cavity for barometric pressure equalization of the gas cavity;

wherein the gas-impermeable flexible membrane comprises a sheet of material that extends across an opening between the as cavity and the air cavity.

18. The speaker system of claim 17 wherein the gas cavity contains a gas that is less dense than air, and no air.

19. The speaker system of claim 18 wherein the gas is selected from a group consisting of helium and hydrogen.

20. The speaker system of claim 17 wherein the gas cavity is sealed by a gas-impermeable speaker frame to which the suspension member is attached.

21. The speaker system of claim 20 wherein the gas cavity houses a drive assembly having a coil and a magnet, the drive assembly is attached to the speaker frame and the diaphragm.

22. The speaker system of claim 17 wherein the gas cavity is sealed by a gas-impermeable electrical signal port.

* * * * *

UNITED STATES PATENT AND TRADEMARK OFFICE

CERTIFICATE OF CORRECTION

PATENT NO. : 8,767,994 B2
APPLICATION NO. : 12/950852
DATED : July 1, 2014
INVENTOR(S) : Tam It is certified that error appears in the above-identified patent and that said Letters Patent is hereby corrected as shown below:

In the Claims

Claim 17, column 8, at line 53, delete “as” and insert --gas--.

Signed and Sealed this
Second Day of September, 2014

Michelle K. Lee

Michelle K. Lee
*Deputy Director of the United States Patent and Trademark Office*